United States Patent [19]

Schweicher et al.

[11] Patent Number: 4,942,068

[45] Date of Patent: Jul. 17, 1990

[54] CURTAIN COATING PROCESS

[75] Inventors: Wolfgang Schweicher, Leverkusen; Hans Frenken, Odenthal-Osenau; Heinrich Bussmann, Leverkusen; Kurt Browatzki, Leverkusen; Johannes Sobel, Leverkusen, all of Fed. Rep. of Germany

[73] Assignee: Agfa-Gevaert Aktiengessellschaft, Leverkuse, Fed. Rep. of Germany

[21] Appl. No.: 142,191

[22] Filed: Jan. 6, 1988

[30] Foreign Application Priority Data

Jan. 13, 1987 [DE] Fed. Rep. of Germany ..... 3700727

[51] Int. Cl.[5] ..... B05D 1/30

[52] U.S. Cl. ..... 427/420; 427/407.1; 427/411; 118/DIG. 4

[58] Field of Search ..... 427/420, 411, 407.1, 427/302, 303; 118/DIG. 4, 300; 430/935

[56] References Cited

U.S. PATENT DOCUMENTS

| | | | |
|---|---|---|---|
| 3,973,062 | 8/1976 | Fahrni | 427/420 |
| 4,241,171 | 12/1980 | Clapp et al. | 430/935 X |
| 4,384,015 | 5/1983 | Koepke et al. | 118/DIG. 4 X |

*Primary Examiner*—Shrive Beck

*Attorney, Agent, or Firm*—Connolly & Hutz

[57] ABSTRACT

Webs coated with several layers, of which the lowermost or uppermost layer contains an instant hardener, may be produced in a single operation by curtain coating using a V-coater when the hardening layer is guided at the negatively inclined sliding surface of the V-coater while the other layers are guided at the opposite sliding surface of the V-coater and the hardening layer is combined with the remaining layers at coating edge to form a layer packet which is applied as a free-falling curtain to the web to be coated.

9 Claims, 1 Drawing Sheet

CURTAIN COATING PROCESS

Figure 1:
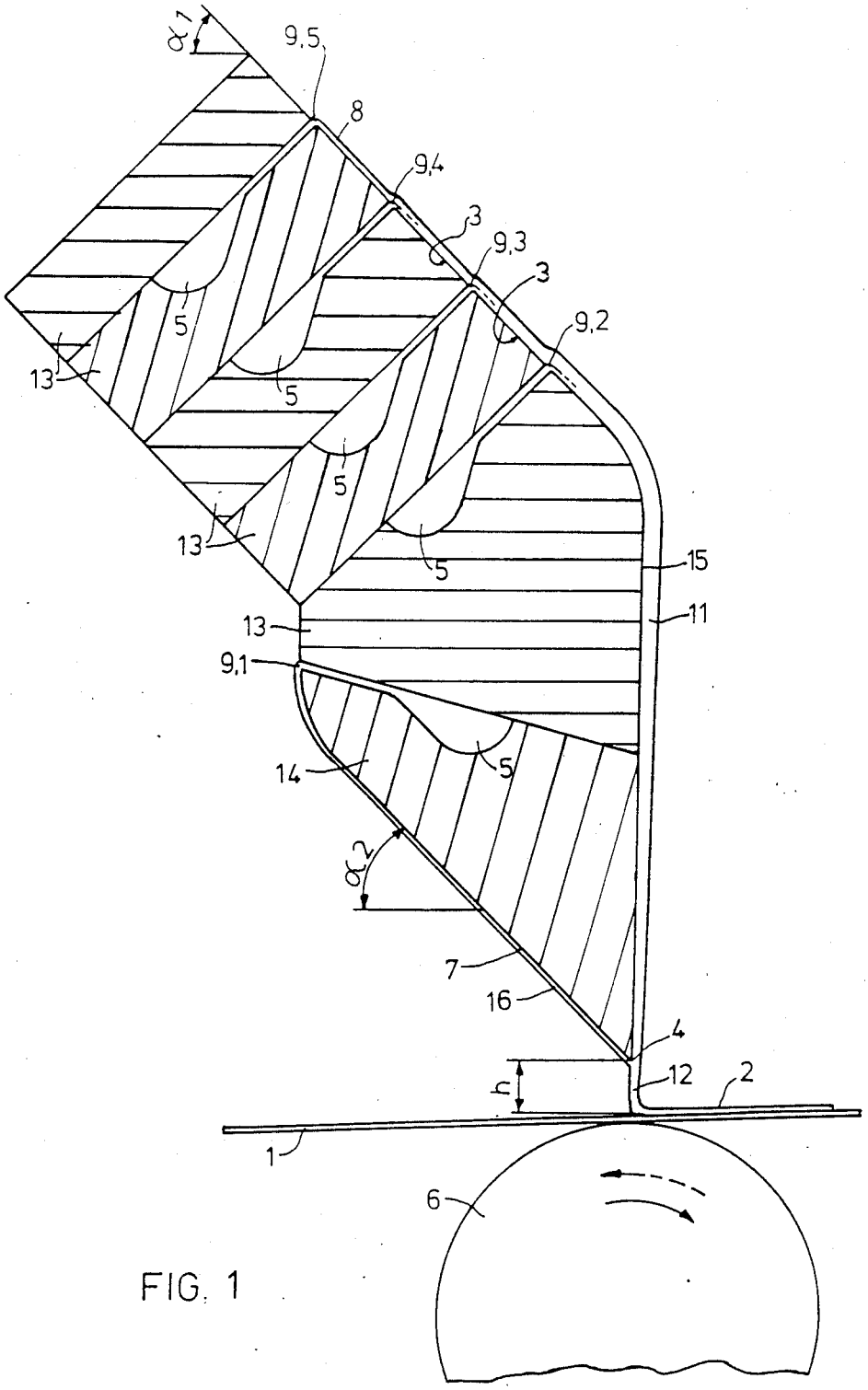

This invention relates to a process for the production of webs coated with several layers, the lowermost or uppermost layer being a layer containing an instant hardener (hardening layer).

For the production of photographic materials, the layers have to be hardened, for which purpose the layers contain protein- and/or polymer-based binders. The following processes are known for hardening:

Conventional hardening with additives, for example triacrylformal, which are added to the coating solutions before they are applied to the web. The web has to be stored for several weeks before hardening of the applied layer packet is complete. The disadvantage of this process lies in the high storage costs and the variable quality attributable to the variable hardening caused by different storage conditions.

The rapid hardening process also uses additives, for example certain vinylsulfones, which are added to the coating solutions. The hardening of the layer packet is complete at the earliest after one day and at the latest after eight days, which is basically of advantage, although very stringent demands are imposed upon the drying and residual moisture content of the products because otherwise the quality of the products is adversely affected by posthardening.

The instant hardening process differs fundamentally from the other two processes. Instant hardeners are understood to be compounds which crosslink suitable binders in such a way that, immediately after coating or after 24 hours at the latest and preferably after 8 hours, hardening has advanced to such an extent that no further change in the sensitometry or swelling of the layer packet is caused by the crosslinking reaction. By swelling is meant the difference between wet layer thickness and dry layer thickness during the aqueous processing of the film (Photogr. Sci. Eng. 8 (1964), 275; Photogr. Sci. Eng. 16 (1972), 449).

Because hardening begins immediately, the instant hardener cannot be added to the usual gelatin-containing coating solutions, because otherwise the production process would have to be interrupted after a short time for cleaning to remove hardener material from the coating machine.

Accordingly, in the instant hardening process, which is of considerable advantage in terms of product quality, the hardener has to be applied in a separate coating solution containing from 0 to 4% by weight and preferably from 0.5 to 1% by weight gelatin or gelatin derivatives either as an additional layer or as part of a layer packet, in which the adjacent layers also have gelatin concentrations of at most only 4% by weight. Where gelatin derivatives are used, they may be present in higher concentrations in the adjacent layers.

Without the above-mentioned restrictions in regard to the gelatin concentration, the only possible solutions are technically more involved. For example, the hardener solution may be applied at a second coating station after drying of the first coating or by separate passage through the machine.

All the disadvantages mentioned above are obviated by the invention described hereinafter.

Accordingly the object of the present invention is to improve the instant hardening process in such a way that the hardener solution may be applied together with all other layers and, hence, with the gelatin-rich coating packets as well in a single coating operation carried out in a single coating machine.

It has surprisingly been found that the instant hardener solution may be applied together with the layer packet using the curtain coater described in DE-OS No. 3 238 905 C2 without any local incrustations, providing the hardener solution is delivered through the rear outlet slot 9.1 described therein and only contacts the layer packet in the curtain. Surprisingly, no coating problems or losses of quality occur at the coating edge where the hardener solution and layer packet come together.

Accordingly, the present invention relates to a process for the production of a web coated with at least two layers, at least one layer containing protein- and/or polymer-based binders and another layer, applied as lowermost or uppermost layer, containing an instant hardener (hardening layer) by the curtain coating process using a V-coater past which the web is continuously guided, characterized in that the hardening layer applied at the same time as the binder-containing layer is guided at the negatively inclined sliding surface of the V-coater while the binder-containing layer is guided at the opposite sliding surface of the V-coater and the hardening layer is combined with the binder-containing layer at the coating edge to form a layer packet which is applied as a free-falling curtain to the web to be coated.

The V-coater is preferably combined with a curtain holder with integrated liquid supply of the type described in U.S. Pat. No. 4,479,987. This curtain holder has the additional advantage that, by virtue of the continuous rinsing, no hardening or incrustation caused by the hardener can form thereon.

In addition, the measure according to the invention of applying the instant hardener solution and the layer packet in a single coating process eliminates the need for the acceleration or wetting layer described in DE No. 3 238 905 C2, because the hardener solution also performs that function This is possible by guiding the web in such a way that the hardener solution is situated beneath the layer packet as coupling layer between the layer packet and the surface of the web (see FIG. 1, solid-line direction of travel of the web). Alternatively, it may form the uppermost layer in the opposite direction of travel of the web (see FIG. 1, chain-line direction of travel of the web) and, hence, may be used as the top layer with surface-specific additives.

Considerable and surprising advantages of the process according to the invention include the saving of a second coating station or of a second passage through the machine for the application of the hardener solution; the avoidance of adjacent layers poor in gelatin and the saving of expensive hardener because the quantity of hardener can be substantially halved without any loss of hardening effect.

FIG. 1 is a section through a curtain coating machine of the V-coater type. This coater consists of the blocks 13 and 14 which are screwed to one another and bounded by end plates. The end plates and also the means by which the coater is fastened to a frame have not been shown. The hardener solution 7 and the liquid coating solutions 8 for the layer packet 11 are introduced into the distributing chamber 5 at one end by means of known dosing units and pipes which it is not intended to describe here. In conjunction with the distributing chambers 5, the outlet slots 9.1 to 9.5 provide for uniform distribution of the coating solutions 8 and of the hardener solution 7. The coating solutions 8 for the layer packet issue from the outlet slots 9.2–9.5 and flow by gravity down the cascade surfaces 3 at an angle $\alpha_1$. Finally, the layer packet 11 flows over the surface 15 to the lowermost V-shaped coating block 14 and to the coating edge 4.

The hardener solution 7 is fed to the distributing chamber 5 between the coating blocks 13 and 14 and flows out through the outlet slot 9.1 onto a sliding surface 16 negatively inclined at an angle $\alpha_2$. It follows the sliding surface 16 and flows from the other side of the coating block 14 to the common coating edge 4. At the coating edge 4, the free-falling curtain 12 is formed from the first-mentioned layer packet 11 and the hardening layer 7. The free-falling curtain 12 reaches the web 1 to be coated in fractions of a second over the height h and applies itself to the web 1. The moving web 1 is supported by the coating rollers 6 where the curtain 12 impinges on it while the edges are held in known manner by curtain guides (not shown). To avoid local hardening, an aqueous inert layer may be arranged between the curtain guides and the layers.

The curtain 12 coats the web 1 over its entire width. Surplus coating material may be drained off at the edges through collecting troughs. Webs without any cut edges are thus formed, being coated with the coating solutions over their entire width without any edge loss.

However, the web 1 is advantageously coated to just short of its edges, for which purpose the curtain 12 is guided in known manner by curtain guide elements extending almost to the web and is thus prevented from contracting through surface tension. Less of the valuable coating solution is lost in this way. The coated web 1 with the coating 2 is thus not coated over its entire width and has to be cut, the uncoated edges and the edge beads being cut off.

FIG. 1 shows chain-line and solid-line directions of travel of the web which are to be interpreted as alternatives. If required or if necessary, the hardener layer 7 may be placed beneath the layer packet 11 or on the layer packet 11.

Although the instant hardener contacts the layer packet 11 in the curtain 12 and at the coating edge 4, no incrustation builds up so that the quality of coating is not affected. The high coating speeds mentioned in DE No. 3 238 905 C2 are maintained.

The hardening layer preferably has a viscosity of from 1 to 30 mPa.s and a wet layer thickness of from 3 to 30 μm; the other layers preferably have viscosities of from 10 to 500 mPa.s and web layer thicknesses of from 5 to 100 μm.

At least one of the other layers preferably contains gelatin and a photosensitive silver halide, while the hardening layer contains from 0 to 4% by weight and preferably from 0.5 to 1% by weight gelatin.

The coating edge is situated in particular 10 to 100 mm above the surface of the web to be coated.

Suitable examples of instant hardeners are compounds corresponding to the following general formulae:

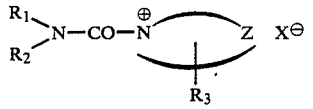

(a)

in which $R_1$ represents alkyl, aryl or aralkyl, $R_2$ has the same meaning as $R_1$ or represents alkylene, arylene, aralkylene or alkaralkylene, the second bond being attached to the group corresponding to the following formula

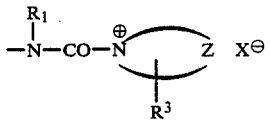

or $R_1$ and $R_2$ together represent the atoms required to complete an optionally substituted heterocyclic ring, for example a piperidine, piperazine or morpholine ring, the ring optionally being substituted, for example, by $C_1$–$C_3$ alkyl or halogen, $R_3$ represents hydrogen, alkyl, aryl, alkoxy, $—NR_4—COR_5$, $—(CH_2)_m—NR_8R_9$, $—(CH_2)_n—CONR_{13}R_{14}$ or

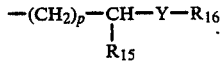

or a bridge member or a direct bond to a polymer chain, $R_4$, $R_6$, $R_7$, $R_9$, $R_{14}$, $R_{15}$, $R_{17}$, $R_{18}$ and $R_{19}$ being hydrogen or $C_1$–$C_4$ alkyl, $R_5$ represents hydrogen, $C_1$–$C_4$ alkyl or $NR_6R_7$, $R_8$ $-COR_{10}$, $R_{10}$ represents $NR_{11}R_{12}$, $R_{11}$ represents $C_1$–$C_4$ alkyl or aryl, more especially phenyl, $R_{12}$ represents hydrogen, $C_1$–$C_4$ alkyl or aryl, more especially phenyl, $R_{13}$ represents hydrogen, $C_1$–$C_4$ alkyl or aryl, more especially phenyl, $R_{16}$ represents hydrogen, $C_1$–$C_4$ alkyl, $COR_{18}$ or $CONHR_{19}$, m is a number of from 1 to 3, n is a number of from 0 to 3, p is a number of from 2 to 3 and Y represents 0 or $NR_{17}$ or $R_{13}$ and $R_{14}$ together represent the atoms required to complete an optionally substituted heterocyclic ring, for example a piperidine, piperazine or morpholine ring, the ring optionally being substituted, for example, by $C_1$–$C_3$ alkyl or halogen, Z represents the carbon atoms required to complete a 5-membered or 6-membered aromatic heterocyclic ring, optionally with a linked benzene ring, and $X^{\ominus}$ is an anion which is dropped if an anionic group is already attached to the remainder of the molecule;

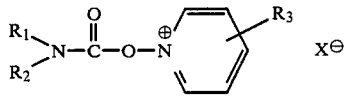

(b)

in which $R_1$, $R_2$, $R_3$ and $X^{\ominus}$ have the same meanings as defined for formula (a);

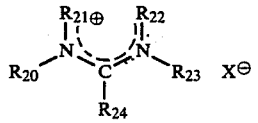

(c)

in which $R_{20}$, $R_{21}$, $R_{22}$, $R_{23}$ represent $C_1$–$C_{20}$ alkyl, $C_6$–$C_{20}$ aralkyl, $C_5$–$C_{20}$ aryl, either unsubstituted or substituted by halogen, sulfo, $C_1$–$C_{20}$ alkoxy, N,N-di-$C_1$–$C_4$-alkyl-substituted carbamoyl and, in the case of aralkyl and aryl, by $C_1$–$C_{20}$ alkyl, $R_{24}$ is a group releasable by a nucleophilic agent and $X^{\ominus}$ has the same meaning as defined for formula (a); 2 or 4 of the substitutents $R_{20}$, $R_{21}$, $R_{22}$ and $R_{23}$ may even be combined together with a nitrogen atom or the group

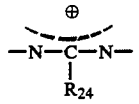

optionally with inclusion of further heteroatoms, such as O or N, to form one or two saturated 5–7-membered rings;

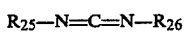

(d)

in which $R_{25}$ represents $C_1$–$C_{10}$ alkyl, $C_5$–$C_8$ cycloalkyl, $C_3$–$C_{10}$ alkoxyalkyl or $C_7$–$C_{15}$ aralkyl, $R_{26}$ has the same meaning as $R_{25}$ or represents a group corresponding to the following formula

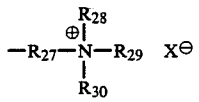

where $R_{27}$ is $C_2$–$C_4$ alkylene and $R_{28}$, $R_{29}$ and $R_{30}$ represent $C_1$–$C_6$ alkyl; one of the groups $R_{28}$, $R_{29}$ and $R_{30}$ may be substituted by a carbamoyl group or a sulfo group and two of the groups $R_{28}$, $R_{29}$ and $R_{30}$ may even be attached, together with the nitrogen atom, to form an optionally substituted heterocyclic ring, for example a pyrrolidine, piperazine or morpholine ring which may be substituted, for example, by $C_1$–$C_3$ alkyl or halogen, and $X^{\ominus}$ has the same meaning as defined for formula (a);

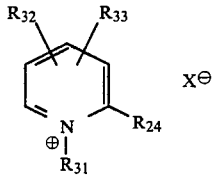

(e)

in which $X^{\ominus}$ has the same meaning as defined for formula (a), $R_{24}$ has the same meaning as defined for formula (c), $R_{31}$ represents $C_1$–$C_{10}$ alkyl, $C_6$–$C_{15}$ aryl or $C_7$–$C_{15}$ aralkyl, either unsubstituted or substituted by carbamoyl, sulfamoyl or sulfo, $R_{32}$ and $R_{33}$ represent hydrogen, halogen, acylamino, nitro, carbamoyl, ureido, alkoxy, alkyl, alkenyl, aryl or aralkyl or together form the remaining members of a ring, more especially a benzene ring, fused to the pyridinium ring;

$R_{24}$ and $R_{31}$ may be attached to one another where $R_{24}$ is a sulfonyloxy group;

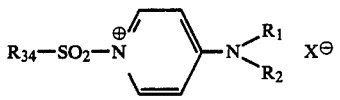

(f)

in which $R_1$, $R_2$ and $X^{\ominus}$ have the same meaning as defined for formula (a) and $R_{34}$ represents $C_1$–$C_{10}$ alkyl, $C_6$–$C_{14}$ aryl or $C_7$–$C_{15}$ aralkyl;

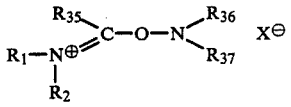

(g)

in which $R_1$, $R_2$ and $X^{\ominus}$ have the same meaning as defined for formula (a), $R_{35}$ represents hydrogen, alkyl, aralkyl, aryl, alkenyl, $R_{38}O$—, $R_{39}R_{40}N$, $R_{41}R_{42}C{=}N$— or $R_{38}S$—, $R_{36}$ and $R_{37}$ represent alkyl, aralkyl, aryl, alkenyl,

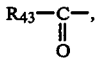

$R_{44}$—$SO_2$ or $R_{45}$—N=N— or, together with the nitrogen atom, represent the remaining members of a heterocyclic ring or the group

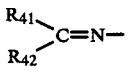

$R_{38}$, $R_{39}$, $R_{40}$, $R_{41}$, $R_{42}$, $R_{43}$, $R_{44}$ and $R_{45}$ represent alkyl, aralkyl, alkenyl, in addition to which $R_{41}$ and $R_{42}$ may represent hydrogen; in addition, $R_{39}$ and $R_{40}$ or $R_{41}$ and $R_{42}$ may represent the remaining members of a 5- or 6-membered, saturated carbocyclic or heterocyclic ring;

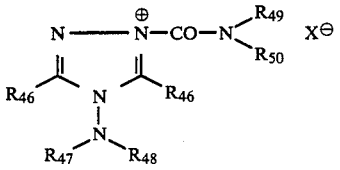

(h)

in which $R_{46}$ represents hydrogen, alkyl or aryl, $R_{47}$ represents acyl, carbalkoxy, carbamoyl or aryloxycarbonyl;

$R_{48}$ represents hydrogen or $R_{47}$ $R_{49}$ and $R_{50}$ represent alkyl, aryl, aralkyl or, together with the nitrogen atom, represent the remaining members of an optionally substituted heterocyclic ring, for example a piperidine, piperazine or morpholine ring, which may be substituted for example by $C_1$–$C_3$ alkyl or halogen, and $X^{\ominus}$ has the same meaning as defined for formula (a);

$$R_{51}[-SO_2-CH=CH_2]_q \quad \text{(i)}$$

in which $R_{51}$ is an optionally substituted heteroaromatic ring containing at least q ring-C-atoms and at least one ring-O-, ring-S- or ring-N-atom and q is an integer of $\geqq 2$.

The heteroaromatic ring represented b $R_{51}$ is, for example, a triazole, thiadiazole, oxadiazole, pyridine, pyrrole, quinoxaline, thiophene, furan, pyrimidine or triazine ring. In addition to the at least two vinylsulfonyl groups, it may optionally contain further substituents and, optionally, fused benzene rings which, in turn, may also be substituted. Examples of heteroaromatic rings ($R_{51}$) are shown in the following:

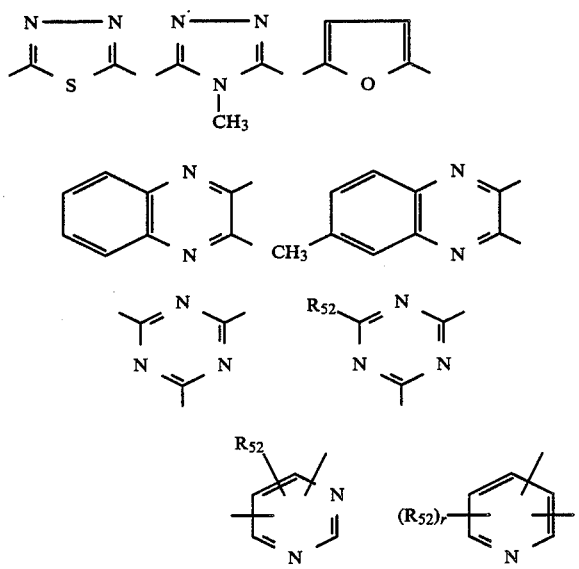

in which r is a number of from 0 to 3 and $R_{52}$ represents $C_1$–$C_4$ alkyl, $C_1$–$C_4$ alkoxy or phenyl.

Finally, suitable instant hardeners are the compounds described in JP-OS Nos. 38 540/75, 93 470/77, 43 353/81 and 113 929/83 and in U.S. Pat. No. 3,321,313.

Unless otherwise defined, alkyl is, in particular, $C_1$–$C_{20}$ alkyl optionally substituted by halogen, hydroxy, sulfo, $C_1$–$C_{20}$ alkoxy.

Unless otherwise defined, aryl is, in particular, $C_6$–$C_{14}$ aryl optionally substituted by halogen, sulfo, $C_1$–$C_{20}$ alkoxy or $C_1$–$C_{20}$ alkyl. Unless otherwise defined, aralkyl is, in particular, $C_7$–$C_{20}$ aralkyl optionally substituted by halogen, $C_1$–$C_{20}$ alkoxy, sulfo or $C_1$–$C_{20}$ alkyl. Unless otherwise defined, alkoxy is in particular $C_1$–$C_{20}$ alkoxy.

$X^{\ominus}$ is preferably a halide ion, such as $Cl^{\ominus}$, $Br^{\ominus}$ or $BF_4^{\ominus}$, $NO_3^{\ominus}$, $(SO_4^{2\ominus})_{\frac{1}{2}}$, $ClO_4^{\ominus}$, $CH_3OSO_3^{\ominus}$, $PF_6^{\ominus}$, $CF_3SO_3^{\ominus}$.

Alkenyl is in particular $C_2$–$C_{20}$ alkenyl. Alkylene is in particular $C_2$–$C_{20}$ alkylene. Arylene is in particular phenylene. Aralkylene is in particular benzylene and alkaralkylene is in particular xylylene.

Suitable N-containing ring systems which may stand for Z are shown on pages 11 and 12. The pyridine ring is preferred.

$R_{36}$ and $R_{37}$ together with the nitrogen atom to which they are attached form in particular a pyrrolidine or piperidine ring having two oxo groups attached in the o- and o'- positions, which ring may be benzo-, cyclohexano- or [2.2.1]-bicyclohexene-condensed.

Acyl is in particular $C_1$–$C_{10}$ alkylcarbonyl or benzoyl: carbalkoxy is in particular $C_1$–$C_{10}$ alkoxycarbonyl; carbamoyl is in particular mono- or di-$C_1$–$C_4$-alkylaminocarbonyl; carboxyl is in particular phenoxycarbonyl.

Groups $R_{24}$ releasable by nucleophilic agents are, for example, halogen atoms, $C_1$–$C_{15}$ alkylsulfonyloxy groups, $C_7$–$C_{15}$ aralkylsulfonyloxy groups, $C_6$–$C_{15}$ arylsulfonyloxy groups and 1-pyridinyl radicals.

Preferred hardeners are listed in the following:

Compounds according to formula (a)

1

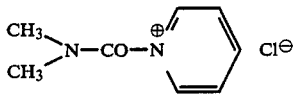

Syrup, highly hygroscopic

2

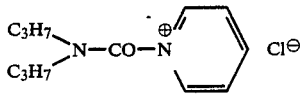

Syrup, highly hygroscopic

3

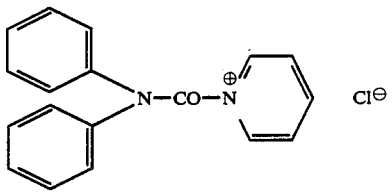

Mp. 112° C.

4

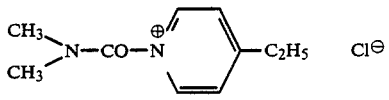

Mp. 103° C.

5

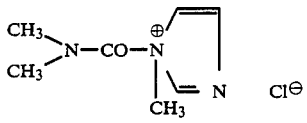

Mp. 87–89° C.

-continued
6
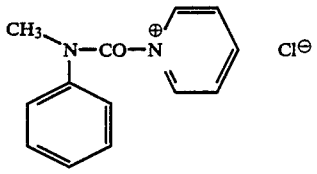
Mp. 108-110° C.
7
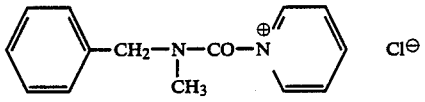
Syrup, hygroscopic
8
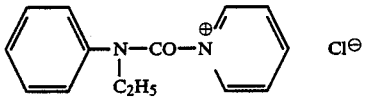
Mp. 105-107° C.
9
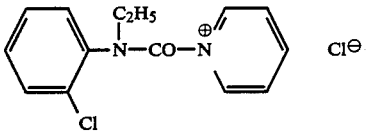
Syrup
10
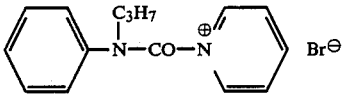
Mp. 103-105° C.
11
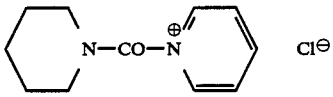
Mp. 75-77° C.
12
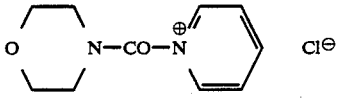
Mp. 110-112° C.
13
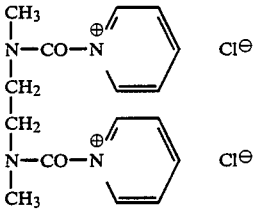
Mp. 95-96° C.
-continued
14
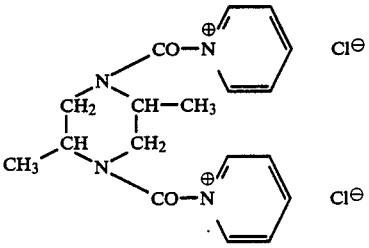
Mp. 106° C.
15
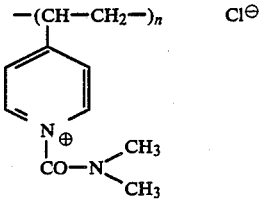
Molecular weight > 10,000
16
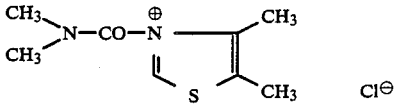
Mp. 66-68° C.
17
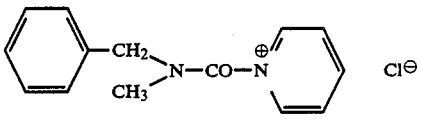
18
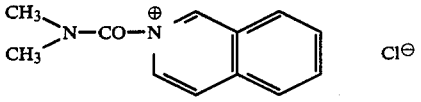
oil
19
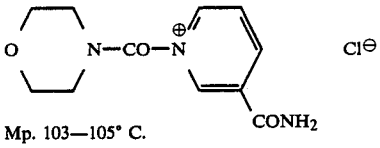
Mp. 103—105° C.
20
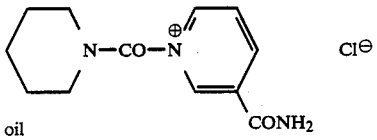
oil
21
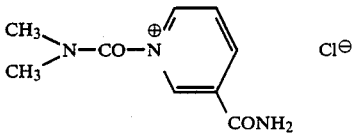
Mp. 109° C.
22
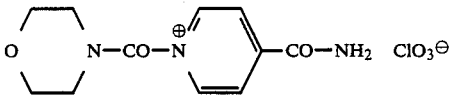

-continued
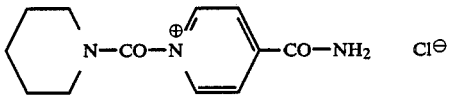
oil
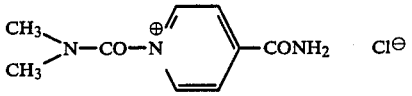
Mp. 115° C.
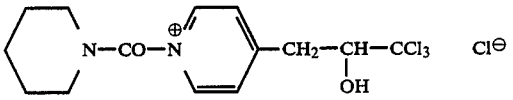
Mp. 154° C.
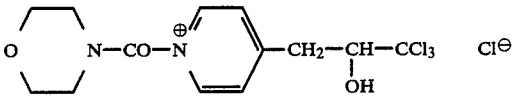
Mp. 140° C.
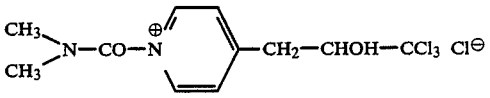
Mp. 115° C.
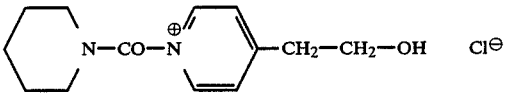
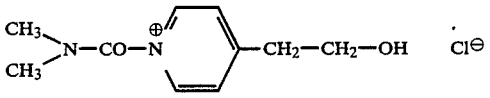
Mp. 140° C.
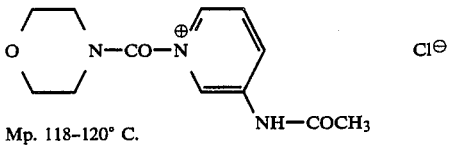
Mp. 118-120° C.
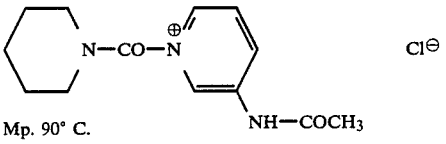
Mp. 90° C.
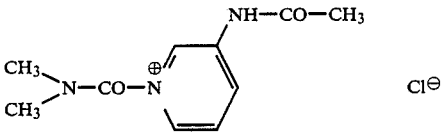
Mp. 210° C.
-continued
23
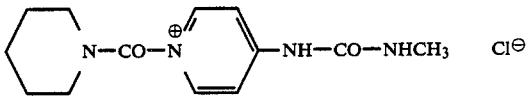
oil
24
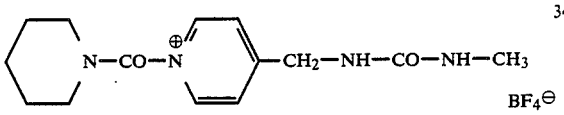
oil
25
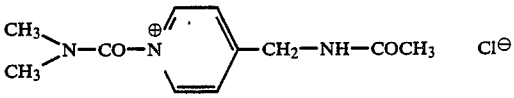
oil
26
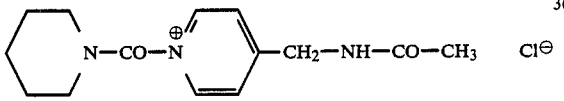
oil
27
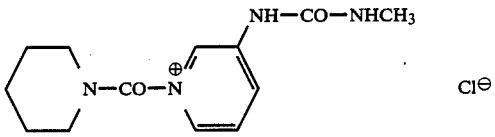
Mp. 60-65° C.
28
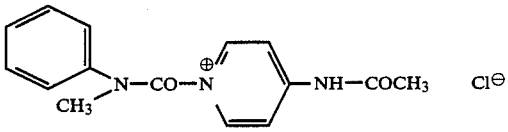
29
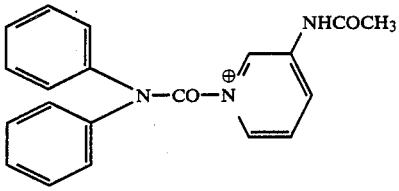
31
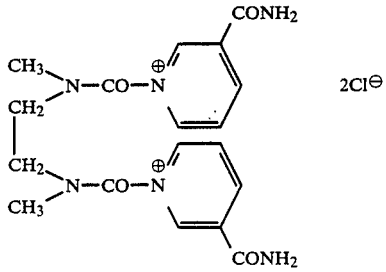
32
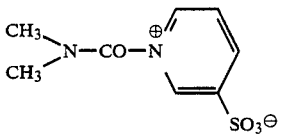
33
34
35
36
37
38
39
40
41

-continued
42
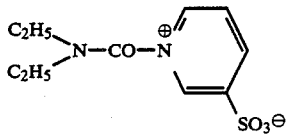
43
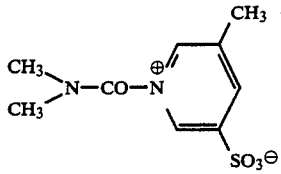
44
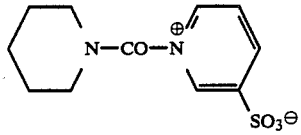
45
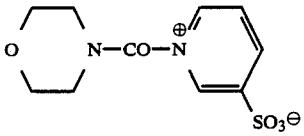
46
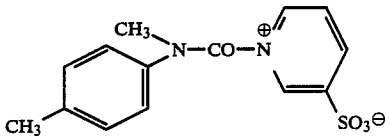
47
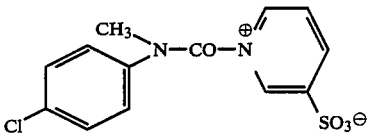
48
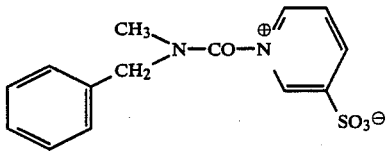
49
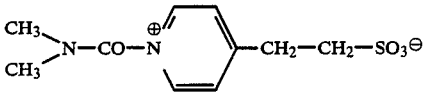
50
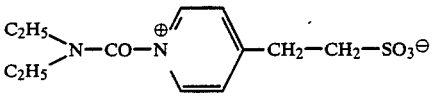
51
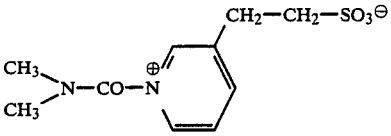
-continued
52
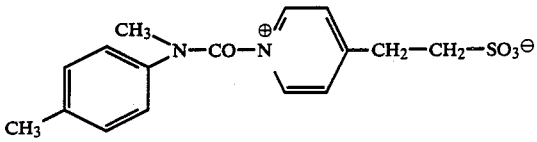
53
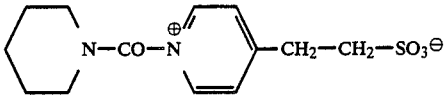
54
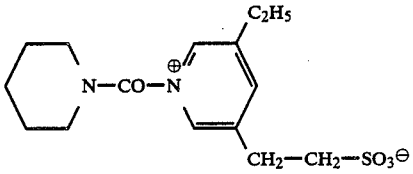
55
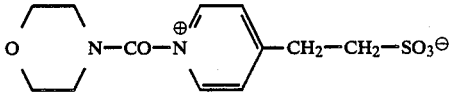
56
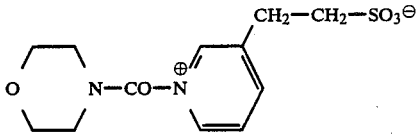
57
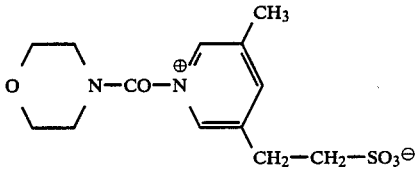
58
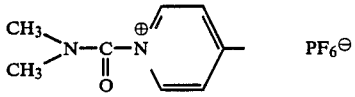
59
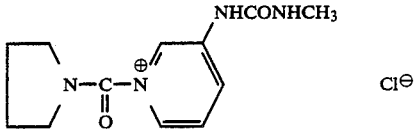
60
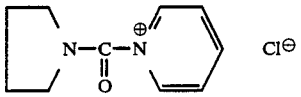
61
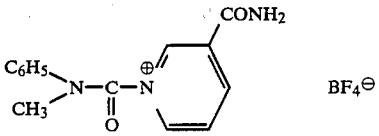
62
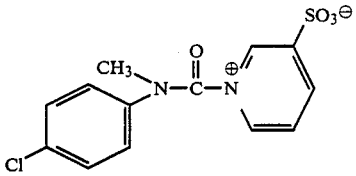

-continued

63 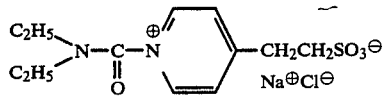

64 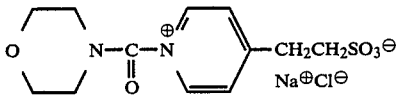

65 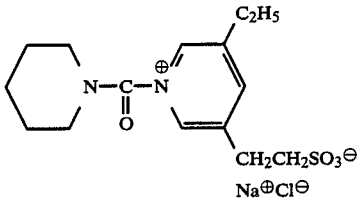

The compounds may be readily obtained by methods known from the literature. The carbamic acid chlorides are prepared from the secondary amines, for example with phosgene, and are then reacted with aromatic, heterocyclic nitrogen-containing compounds in the absence of light. The preparation of compound 3 is described in Chemische Berichte 40, (1907), page 1831. Further information on the synthesis can be found in DE-OS No. 2 225 230, DE-OS No. 2 317 677 and DE-OS No. 2 439 551.

Compounds corresponding to formula (b)

Processes for the synthesis of these compounds are described, for example, in De-A No. 2 408 814:

66 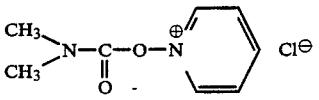

67 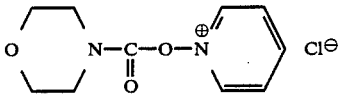

68 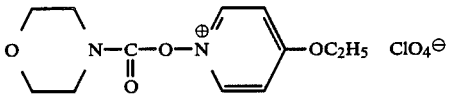

69 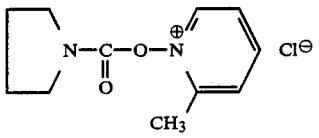

70 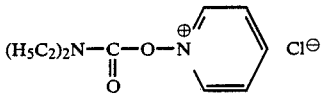

Compounds corresponding to formula (c)

Methods for the synthesis of these compounds are described in detail in Chemistry Letters (The Chemical Society of Japan), page 1891–1894 (1982). Further particulars of the synthesis can also be found in EP-A No. 162 308.

71 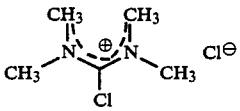

72 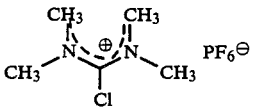

73 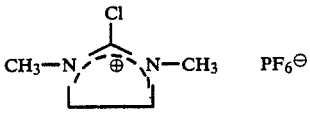

74 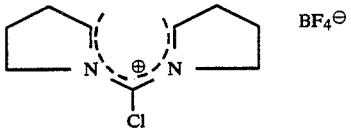

75 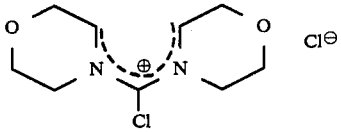

76 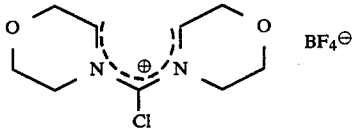

77 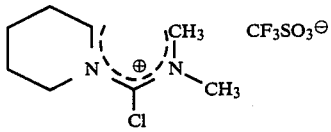

78 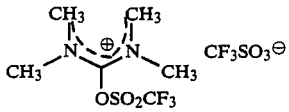

Compounds corresponding to formula (d)

Methods for the synthesis of these compounds are described in detail in JP-OS Nos. 126 125/76 and 48 311/77.

79 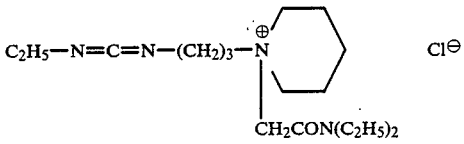

80 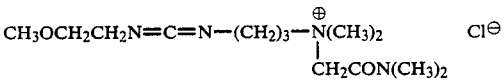

81 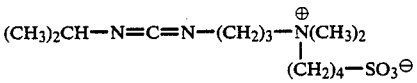

-continued

82

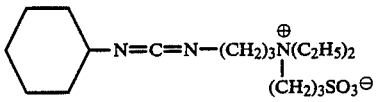

83

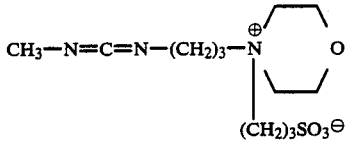

84

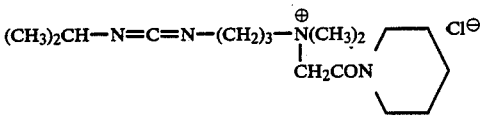

85

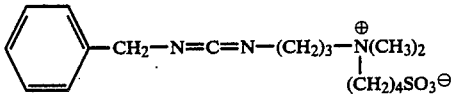

Compounds corresponding to formula (e)

Methods for the synthesis of these compounds are described in detail in JP-OS Nos. 44 140/82 and 46 538/82 and in JP-OS No. 50 669/83.

86

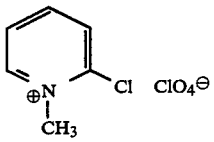

87

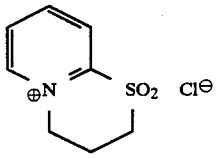

88

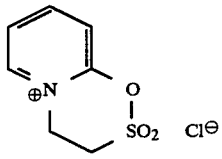

89

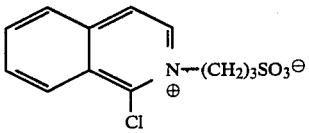

90

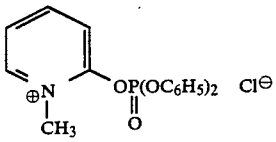

-continued

91

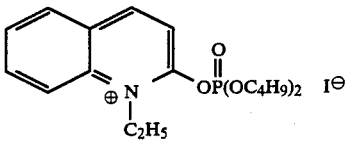

Compounds corresponding to formula (f)

Methods for the synthesis of these compounds are described in detail in JP-OS No. 54 427/77.

92

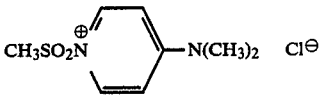

93

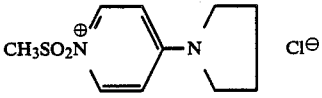

94

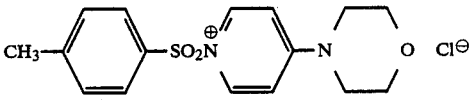

Compounds corresponding to formula (g)

The synthesis of these compounds is described in U.S. Pat. No. 4,612,280.

95

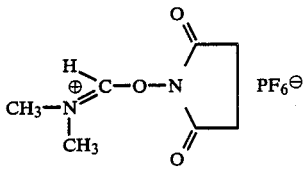

96

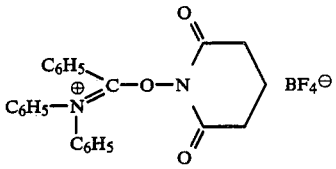

97

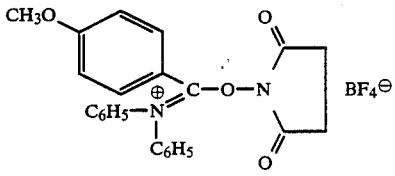

98

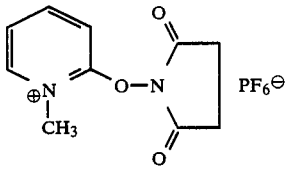

-continued
99
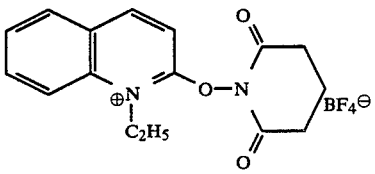
100
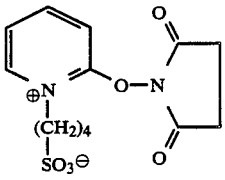
101
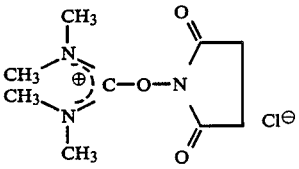
102
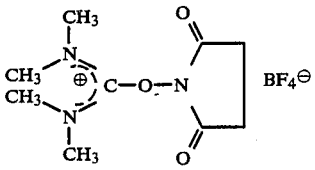
103
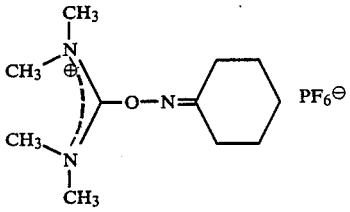
104
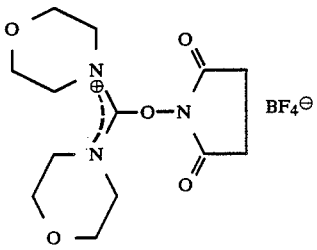
105
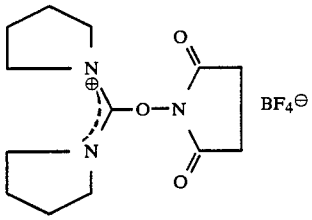
-continued
106
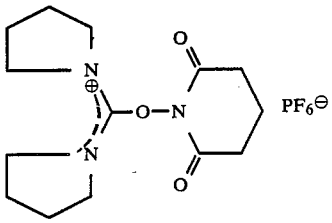
107
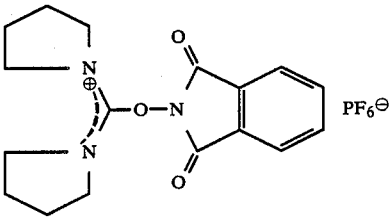
108
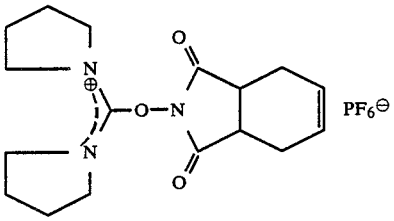
109
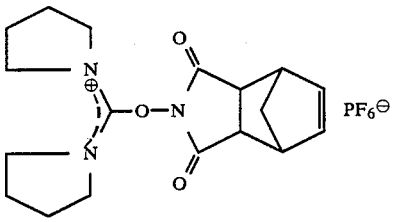
110
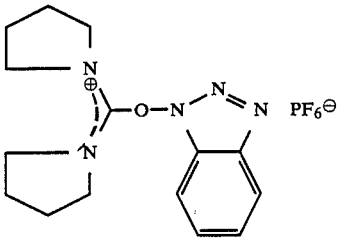
111
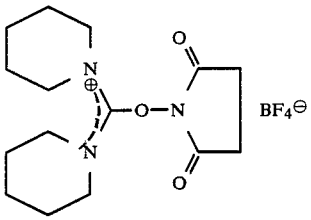

-continued
112
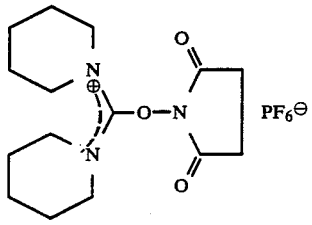
113
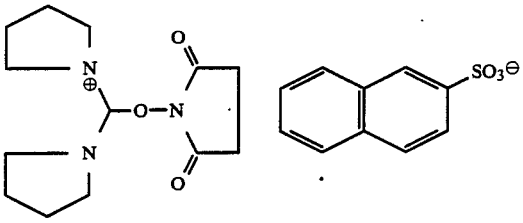
114
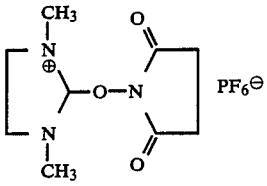
115
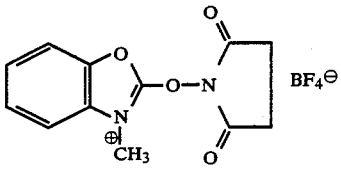
116
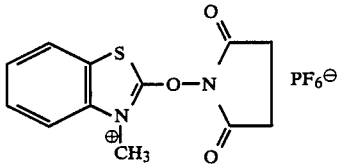
117
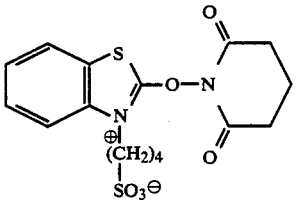
Compounds corresponding to formula (h)
The preparation of these compounds is described in DD No. 232 564 A 1.
118
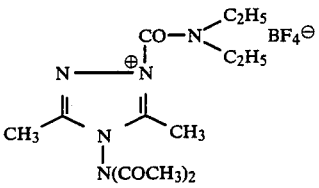
-continued
119
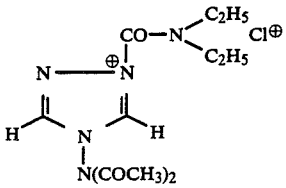
120
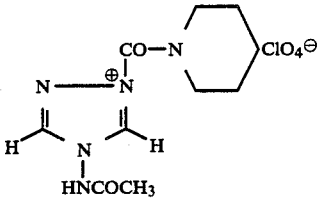
121
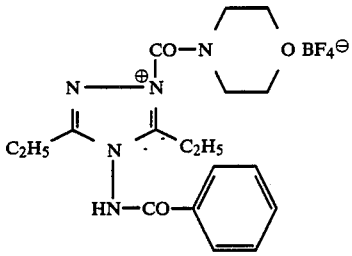
122
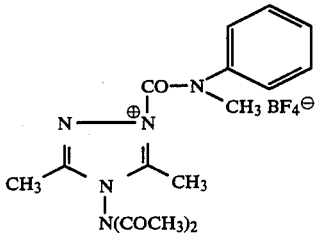
123
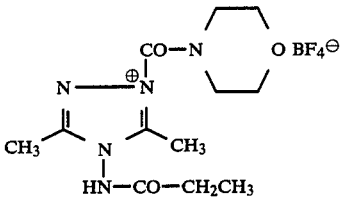
Compounds corresponding to formula (i)
Methods for the preparation of these compounds are described in DE-OS No. 35 23 360.
124
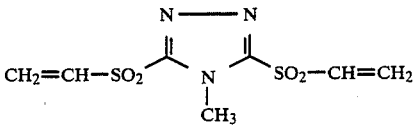
125
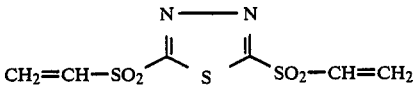

-continued

126

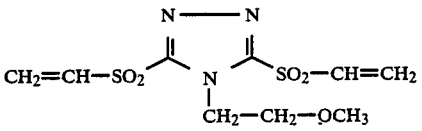

127

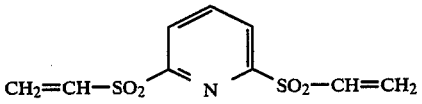

Other suitable instant hardeners correspond to the following formulae:

128

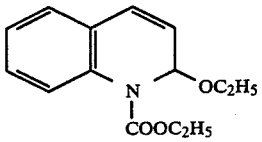

129

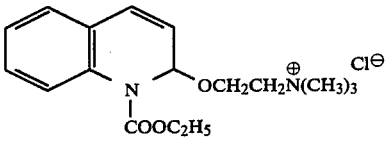

130

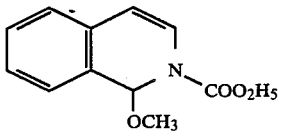

(JP-OS 38 540/75)

131

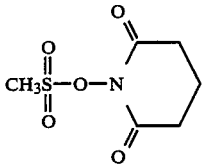

132

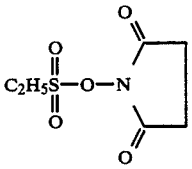

(JP-OS 93 470/77)

133

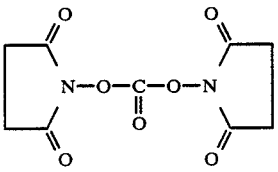

134

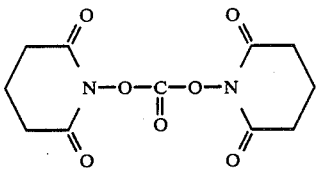

-continued

135

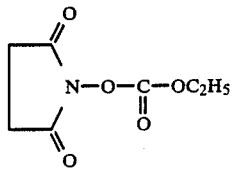

(JP-OS 43 353/81)

136

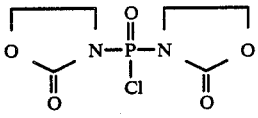

137

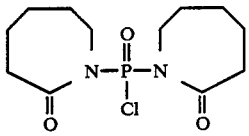

(JP 113 929/83)

138

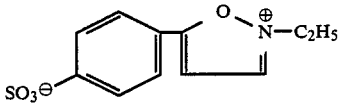

139

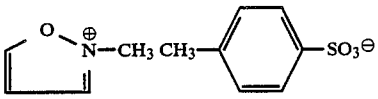

140

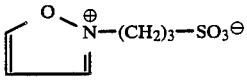

141

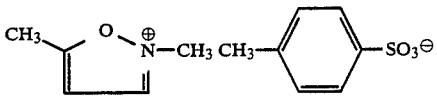

142

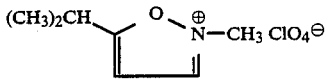

143

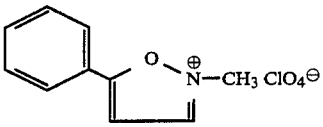

144

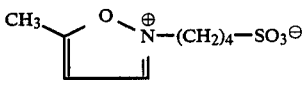

(US-PS 3 321 313)

The symbols used in the following Table have the following meanings:

| | |
|---|---|
| $\eta$ = viscosity | (mPa.s) |
| $\sigma$ = surface tension | (mN/m) |
| $\delta$ = wet coating on web | ($\mu$m) |
| $v$ = speed of travel of web | (m/min.) |
| h = curtain height | (mm) |

A coating machine of the type shown in FIG. 1 (V-coater) was used for an eight-layer coating (one instant hardened layer, 7-layer photographic layer packet).

The coating data of the individual layers were as follows:

| Outlet slot | Nature of coating solution | δ | η | σ | h | ν |
|---|---|---|---|---|---|---|
| 9.1 | Instant hardener solution | 7 | 3 | 30 | | |
| 9.2 | Photographic layer | 15 | 40 | 35 | | |
| 9.3 | Intermediate layer | 15 | 40 | 35 | | |
| 9.4 | Photographic layer | 15 | 40 | 35 | 70 | 200 |
| 9.5 | Intermediate layer | 15 | 40 | 35 | | |
| 9.6 | Photographic layer | 15 | 40 | 35 | | |
| 9.7 | Intermediate layer | 15 | 30 | 35 | | |
| 9.8 | Cover layer | 10 | 10 | 32 | | |

The direction of travel of the web was selected so that the instant hardener layer was applied as the uppermost layer of the coating 2 (FIG. 1, direction of web travel in chain lines). A PE-paper substrate was used as the web.

The coating quality was good and no incrustations were formed on the coater. An aqueous solution of the following compound

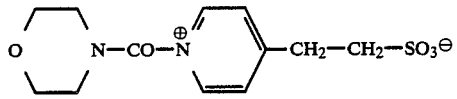

was used as the instant hardener solution.

Where 2 coating stations or two machine passes were used, the same coating quality was only achieved with a 12 μm application of hardener, 7 μm in accordance with the invention.

According to the invention, less or more than 8 layers may be applied. The process is particularly suitable for applying 2 to 20 layers.

We claim:

1. A process for the production of a web coated with at least two layers, at least one layer containing binders based on proteins and/or synthetic polymers and another layer, applied as the lowermost or uppermost layer, containing an instant hardener (hardening layer), by the curtain coating method using a V-coater past which the web is continuously guided, characterized in that the hardening layer applied at the same time as the binder-containing layer is guided at the negatively inclined sliding surface of the V-coater while the binder-containing layer is guided at the opposite sliding surface of the V-coater and the hardening layer is combined with the binder-containing layer at the coating edge to form a layer packet which is applied as a free-falling curtain to the web to be coated.

2. A process as claimed in claim 1, characterized in that the layer containing the instant hardener has a viscosity of from 1 to 30 mPa.s and a wet layer thickness of from 3 to 30 μm.

3. A process as claimed in claim 1, characterized in that at least one of the other layers contains gelatin and a photosensitive silver halide.

4. A process as claimed in claim 1, characterized in that the instant hardener is applied in a coating solution containing from 0 to 4% by weight gelatin.

5. A process as claimed in claim 1, characterized in that the instant hardener is applied in a coating solution containing a gelatin derivative.

6. A process as claimed in claim 1, characterized in that the coating edge is situated 10 to 100 mm above the surface of the web to be coated.

7. A process as claimed in claim 1, characterized in that the curtain is held by a curtain holder with integrated liquid supply.

8. A process as claimed in claim 1, characterized in that the web is coated with 2 to 20 layers.

9. A process as claimed in claim 1, characterized in that the instant hardener corresponds to the following general formula

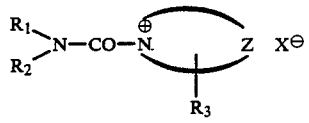

in which $R_1$ represents alkyl, aryl or aralkyl, $R_2$ has the same meaning as $R_1$ or represents alkylene, arylene, aralkylene or alkaralkylene, the second bond being attached to a group of the formula

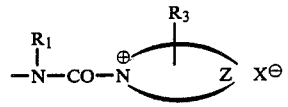

or $R_1$ and $R_2$ together represents the atoms required to complete an optionally substituted heterocyclic ring, $R_3$ represents hydrogen, alkyl, aryl, alkoxy-, $—NR_4—COR_5$, $—(CH_2)_m—NR_8R_9$, $—(CH_2)_n—CONR_{13}R_{14}$ or $$—(CH_2)_p—\underset{\underset{R_{15}}{|}}{CH}—Y—R_{16}$$

or a bridge member or a direct bond to a polymer chain, $R_4$, $R_6$, $R_7$, $R_9$, $R_{14}$, $R_{15}$, $R_{17}$, $R_{18}$ and $R_{19}$ being hydrogen or $C_1$–$C_4$ alkyl, $R_5$ represents hydrogen, $C_1$–$C_4$ alkyl or $NR_6R_7$, $R_8$ represents $—COR_{10}$, $R_{10}$ represents $NR_{11}R_{12}$, $R_{11}$ represents $C_1$–$C_4$ alkyl or aryl, $R_{12}$ represents hydrogen, $C_1$–$C_4$ alkyl or aryl, $R_{13}$ represents hydrogen, $C_1$–$C_4$ alkyl or aryl, $R_{16}$ represents hydrogen, $C_1$–$C_4$ alkyl, $COR_{18}$ or $CONHR_{19}$, m is a number of from 1 to 3, n is a number of from 0 to 3, p is a number of from 2 to 3 and Y represents O or $NR_{17}$ or $R_{13}$ and $R_{14}$ together represent the atoms required to complete an optionally substituted heterocyclic ring, Z represents the C atoms required to complete a 5- or 6-membered aromatic heterocyclic ring, optionally with a fused benzene ring, and $X^{\ominus}$ is an anion which drops out where an anionic group is already attached to the rest of the molecule.

* * * * *